United States Patent [19]

Kosaka et al.

[11] Patent Number: 5,048,819

[45] **Date of Patent: * Sep. 17, 1991**

[54] SORTING MACHINE HAVING AN UPPERMOST TRAY WHICH IS ONLY USED IN THE NON-SORTING MODE

[75] Inventors: Kenji Kosaka, Naka; Yoshikazu Yasu, Katsuta, both of Japan

[73] Assignee: Ikegami Tsushinki Co., Ltd., Tokyo, Japan

[ * ] Notice: The portion of the term of this patent subsequent to Jun. 6, 2006 has been disclaimed.

[21] Appl. No.: 464,436

[22] Filed: Jan. 12, 1990

[51] Int. Cl.[5] ..... B65H 39/10

[52] U.S. Cl. ..... 271/288; 271/296; 271/303

[58] Field of Search ..... 271/288, 296, 298, 303

[56] References Cited

U.S. PATENT DOCUMENTS

| | | | |
|---|---|---|---|
| 4,548,403 | 10/1985 | Matsui et al. | 271/296 |
| 4,709,915 | 12/1987 | Ishikawa et al. | 271/288 |
| 4,836,529 | 6/1989 | Kosaka et al. | 271/296 |
| 4,842,264 | 6/1989 | Kosaka et al. | 271/296 |
| 4,973,041 | 11/1990 | Yamasaki | 271/288 |

FOREIGN PATENT DOCUMENTS

| | | |
|---|---|---|
| 0018786 | 11/1980 | European Pat. Off. . |
| 0301595 | 2/1989 | European Pat. Off. . |
| 3313753 | 10/1983 | Fed. Rep. of Germany . |

OTHER PUBLICATIONS

Tates, D. W., "Sorter with Dual Purpose Tray", *Xerox Disclosure Journal*, vol. 1, No. 4, p. 61, Apr. 1976.

*Primary Examiner*—Robert P. Olszewski
*Assistant Examiner*—Steve Rim
*Attorney, Agent, or Firm*—Oliff & Berridge

[57] ABSTRACT

A sheet sorting device includes a plurality of trays which are immovably arranged in a vertical array, a sheet ejection unit which is selectively movable from tray to tray and which includes a guide member which guides a sheet into the entrance of the tray and an ejection roller which ejects the sheet. The ejection unit is connected with drive mechanism which includes a Geneva cam and wheel arrangement. Each rotation of the Geneva cam moves the ejection unit from one tray entrance to a predetermined position with respect to the next entrance. During non-sorting modes, the ejection unit is set in a predetermined high position above the uppermost tray wherein the distance between the ejection unit and the uppermost tray is greater than the space between trays.

8 Claims, 6 Drawing Sheets

SORTING MACHINE HAVING AN UPPERMOST TRAY WHICH IS ONLY USED IN THE NON-SORTING MODE

BACKGROUND OF THE INVENTION

1. Field of the Invention

The present invention relates generally to a sorting machine and more specifically to a sorting machine which is suited for use with a printer or copy machine.

2. Description of the Prior Art

A sorting machine of the type wherein a plurality of trays (bin) are immovably disposed in a fixed vertical array and the sheets of printed matter are selectively transported to a preselected tray by a suitable sheet transport mechanism, is known. U.S. Pat. No. 4,836,529 shows an example of such a type of sorting machine.

However, with this prior art arrangement, irrespective of the selected mode of operation the number of sheets which can be collected on any one tray is limited to the same number. Viz., during the non-sorting mode the number of sheets which can be collected is limited to the same number as in the case of the sorting and/or group modes.

Accordingly, during the non-sorting mode, when a large number of sheets are often required to be collected in a single tray, as the tray fills, the space available for subsequent sheets to be ejected and collected rapidly diminishes and the situation wherein a sheet which is being ejected into a tray tends to catch on the previously ejected one and brings about a condition wherein troublesome jamming or the like improper operation of the sorting device occurs.

SUMMARY OF THE INVENTION

It is an object of the present invention to provide a sorting arrangement of the nature disclosed above wherein the number of sheets which can be collected during the non-sorting mode is greatly increased and the tendency for sheets to catch on one another and/or not be smoothly ejected and received in the tray is notably attenuated.

In brief, the above object is achieved by an arrangement wherein, during non-sorting modes, a selectively movable ejection unit which can be moved up and down along one side of the tray bin, is set in a predetermined position above an uppermost tray and in a position wherein the distance between the ejection unit and the upper tray is notably larger than the distance the ejection unit is normally located above the other trays during sorting and group modes.

In the disclosed embodiment this high setting is achieved by rotating a Geneva cam which forms part of the ejection unit motivation arrangement, twice instead of the normal single rotation usually executed during a sorting or group mode of operation.

More specifically, the present invention is deemed to comprise a sorting machine which features:

a plurality of tray bins which are arranged in a fixed vertical array with a predetermined space therebetween, each of the tray bins having an entrance through which sheets can be ejected thereonto;

means movable along the entrances of the tray bins for ejecting a sheet onto the tray bins;

means for transferring a sheet to the ejecting means;

means for intermittently shifting the ejecting means;

means for detecting a predetermined mode of operation including a non-sorting mode; and means responsive to the detection of the non-sorting mode by the detecting means for moving the ejecting means to the uppermost tray of the tray bins and locating the ejecting means at a distance above the uppermost tray which is greater than the predetermined space.

In accordance with the present invention, during sorting the sheet of printed matter is pressed against a plurality of transfer belts by a spring strip arrangement which is designed to exert a predetermined force on one face of the sheets undergoing transportation. This ensures that the sheet moves synchronously with the transfer belts and is securely delivered to the ejection unit. This unit is arranged so that, after ejecting a sheet into one tray during a sorting mode, it is moved and positioned with respect to the next selected tray ready for ejection thereinto. Each time the ejection unit is moved, it is moved through the same distance and then held stationary during sheet ejection.

When a non-sorting mode is selected the ejection unit is moved directly to the upper tray and then set in a position with respect to the tray so that the distance between it and the upper tray is notably larger than that which is established between the ejection unit and the trays below the top one during the sorting mode. As a result, a larger number of sheets than possible with the above discussed prior art arrangement can be collected on the upper tray without incident or the need to break the delivery into smaller lots.

The above and other objects, effects, and features are apparent from the following description of embodiments thereof taken in conjunction with the accompanying drawings.

DETAILED DESCRIPTION OF THE PREFERRED EMBODIMENTS

Figure 1:
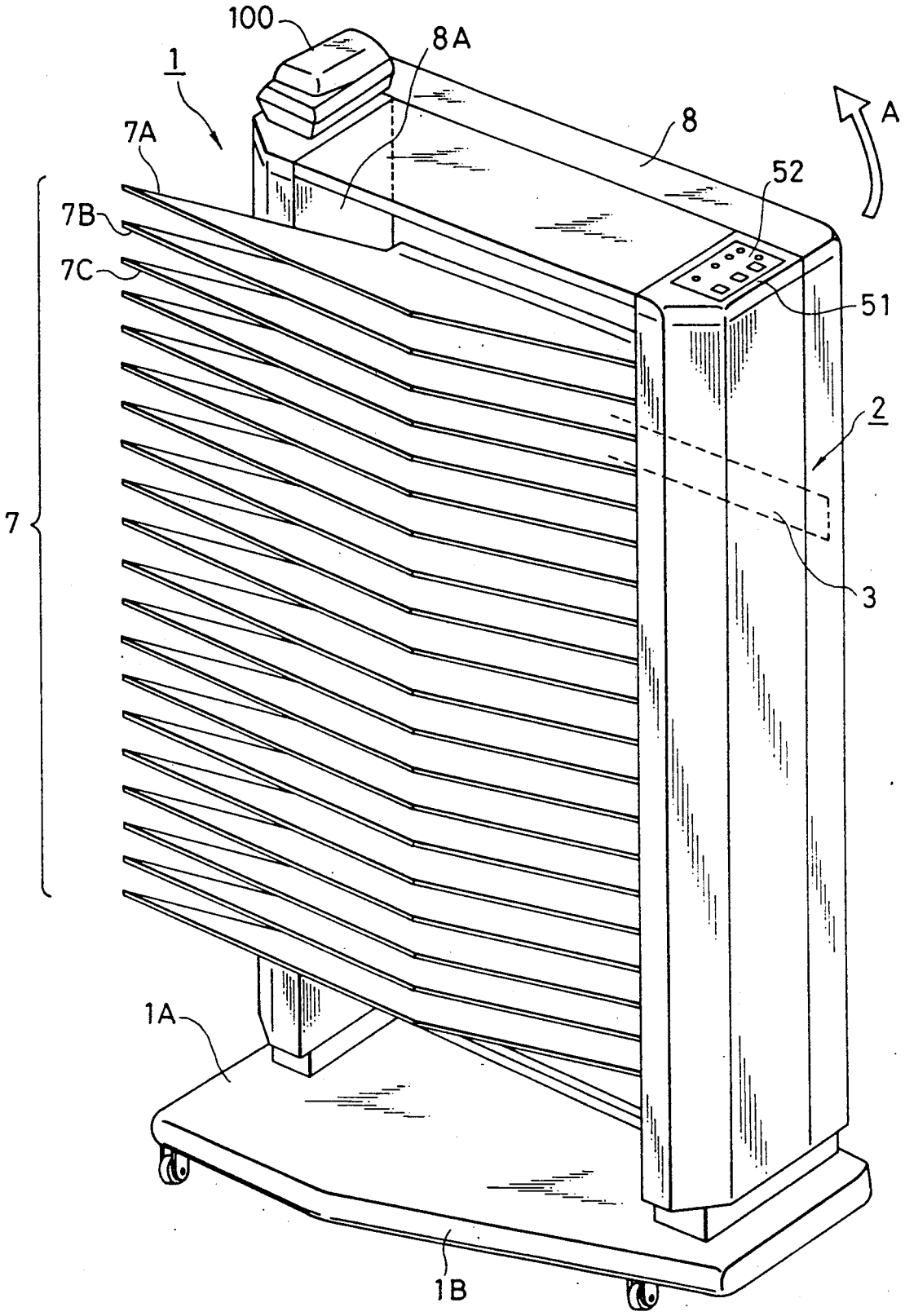
FIG. 1 is a perspective view showing a sorting machine to which the present invention is applied.
Figure 2:
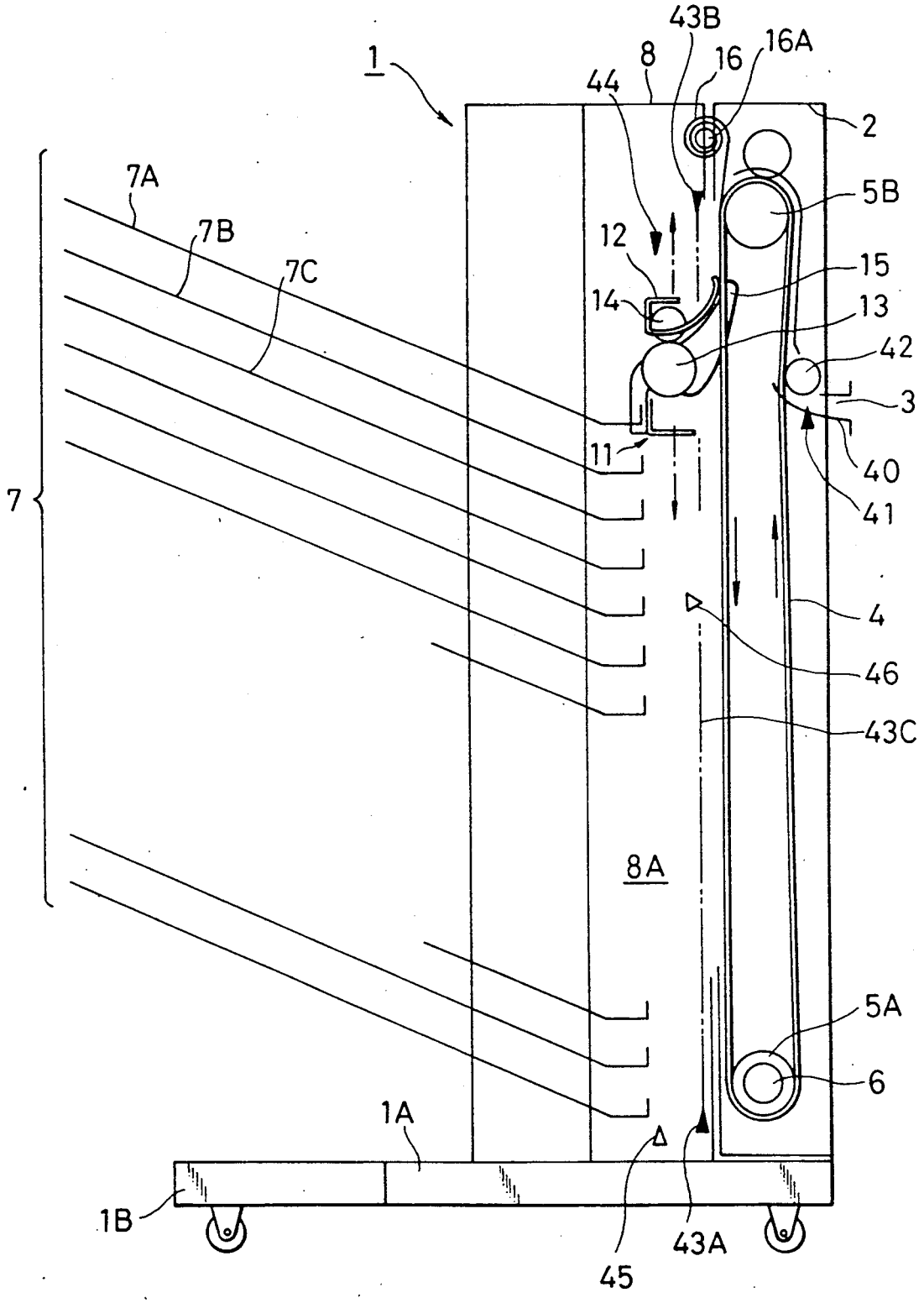
FIG. 2 is a side schematic view depicting the constructional arrangement which characterizes the sorting machine shown in FIG. 1.

FIGS. 1 to 6 show details of a sorting device to which the present invention is applied. In FIG. 1 the numeral 1 generally denotes a sorting section while the numeral 2 generally denotes a feed section 2. As illustrated in FIG. 2, the feed section 2 comprises a sheet feed opening 3, a plurality of spaced sheet transfer belts 4 which pass over drive and idler pulleys 5A, 5B, and a feed motor 6 which is operatively connected to the shaft on which the drive pulleys are mounted.

The feed section 1 is hingedly mounted and arranged so that, in the case of jamming due to sheet becoming crumpled or the like during either transportation or ejection; or alternatively, when a maintenance inspection is to be carried out, the feed section can be selectively unlatched and swung apart from the sorting section 1 to facilitate ready access to the mechanisms which are disposed therewithin.

It should be noted that in this connection, an open/-closed sensor 46 is disposed in the sorting section 1 and operatively arranged with a manually operable latch arrangement (not shown) which is arranged to releasably lock the two sections together, and arranged to detect the two sections being properly latched together.

In addition to this, as shown in FIG. 1, the sorting and feed sections 1, 2 are supported on a common mobile base 1A. In this instance the front corner of the base 1A is formed with an angled portion 1B which is designed to permit an operator to stand closer to the sorting device and to more readily remove sheets from the vertical array of trays 7.

An electric stapler 100 is mounted on a shoulder portion of a case 8 which encloses the sorting section 1.

The case 8 in which the sorting section is housed, includes a side wall or frame section 8A on which the trays 7 are fixedly supported.

An ejection unit 11 is operatively mounted on a support frame 12 which is arranged to be slidable up and down within the case. A plurality of eject rollers 13 are rotatably supported on the frame 12 in a manner to cooperate with corresponding idler rollers 14. Upwardly extending guide fingers or claws 15 are arranged on either side of each of the eject rollers 13 as shown in FIG. 3.

A plurality of strips 16 of springy material are each wound on a spool 16B. As shown in FIG. 3 each of the spools 16B are rotatably supported on a shaft 16A which extends laterally across the upper interior of the case 8. The strips 16 are arranged to re-wind back onto the spools 16B with a predetermined and essentially constant force irrespective of how much is wound off. The spring strips 16 (as they will be referred to hereinafter) have smooth surfaces which exhibit a low coefficient of friction. The lower ends of the spring strips 16 are connected to the support frame 12 and are arranged to extend in an alternate or staggered relationship with respect to the transfer belts 4 which cause a sheet 20, which is being moved through the sorting section 1, to be pressed against the surfaces of the transfer belts 4 in a manner which ensures that it will be moved in the desired synchronous manner therewith.

The guide fingers 15 are arranged to extend into the path of the sheets being transferred and guide the same away from the transfer belts against which they have been held, between the eject and idler rollers 13 and 14 and toward a tray 7.

Figure 3:
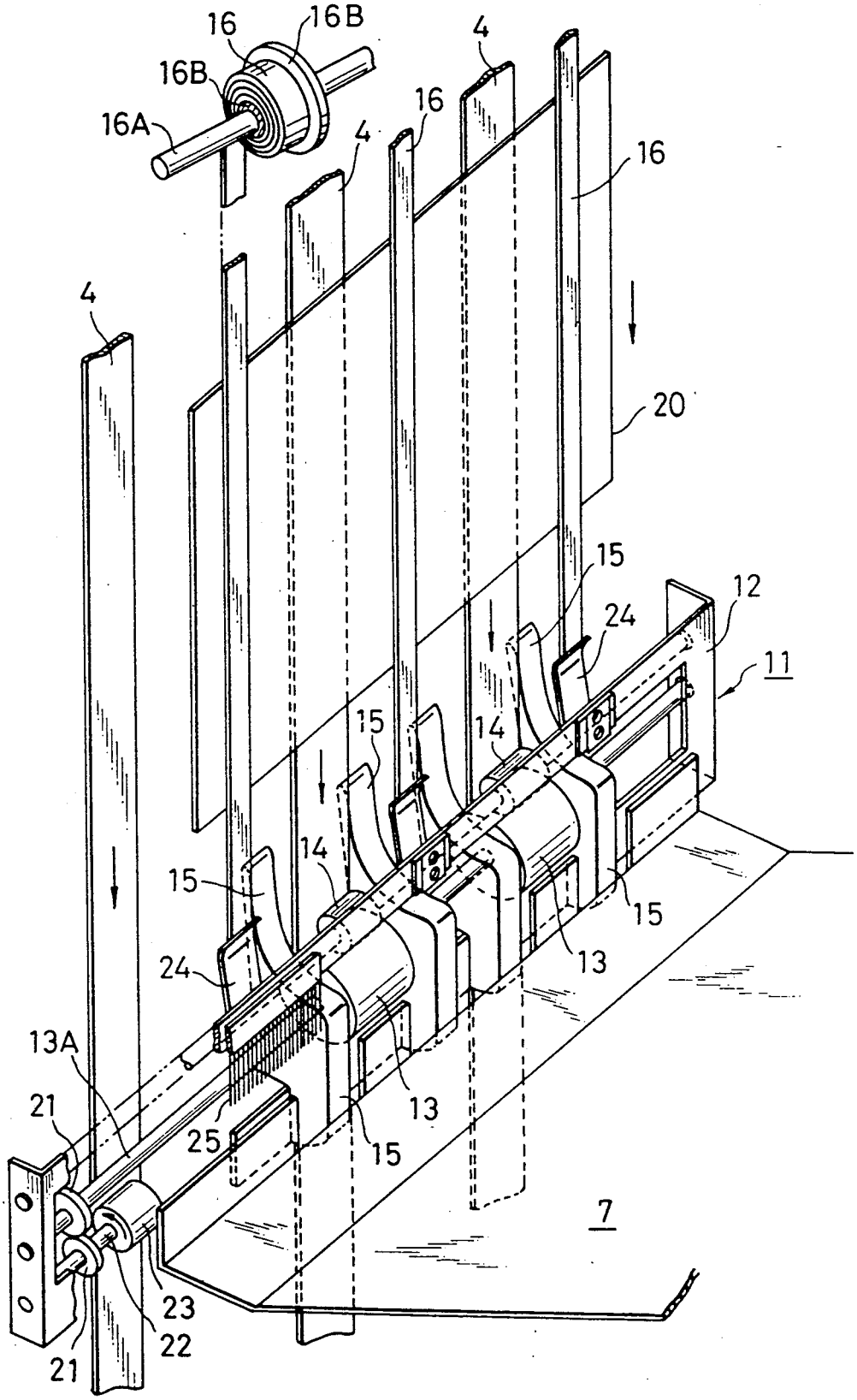
FIG. 3 is a perspective view showing details of an ejection unit which forms a vital part of the sorting device to which the present invention is applied.

FIG. 3 shows a sheet 20 being guided toward a tray 7 by the eject unit 11.

Intermeshing gears 21, 21 establish a drive connection between a pulley 23 which is mounted on a shaft 22 and held in drive contact with the surface of one of the transfer belts 4, and a shaft 13A on which the eject rollers 13 are mounted. As the pulley 23 is smaller in diameter than eject rollers 13, and the gears 21, 21 are essentially the same size, the arrangement defines a step-up gearing which rotates the eject and idler rollers 13, 14 in a manner wherein the surface speed of the rollers is greater than the transfer belts 4. This arrangement tends to securely pick up the sheet and obviate jamming.

Curved metal fasteners 24 are fixedly mounted on the frame 12. These fasteners 24 serve to interconnect the lower ends of the spring strips 16 to the frame 12 and hold the same in the desired relationship with respect to the transfer belts 4.

A brush 25 for removing static electricity is mounted on the frame 12 and arranged to sweep over the surface of the sheets as they pass between the eject and idler rollers 13, 14.

Figure 4:
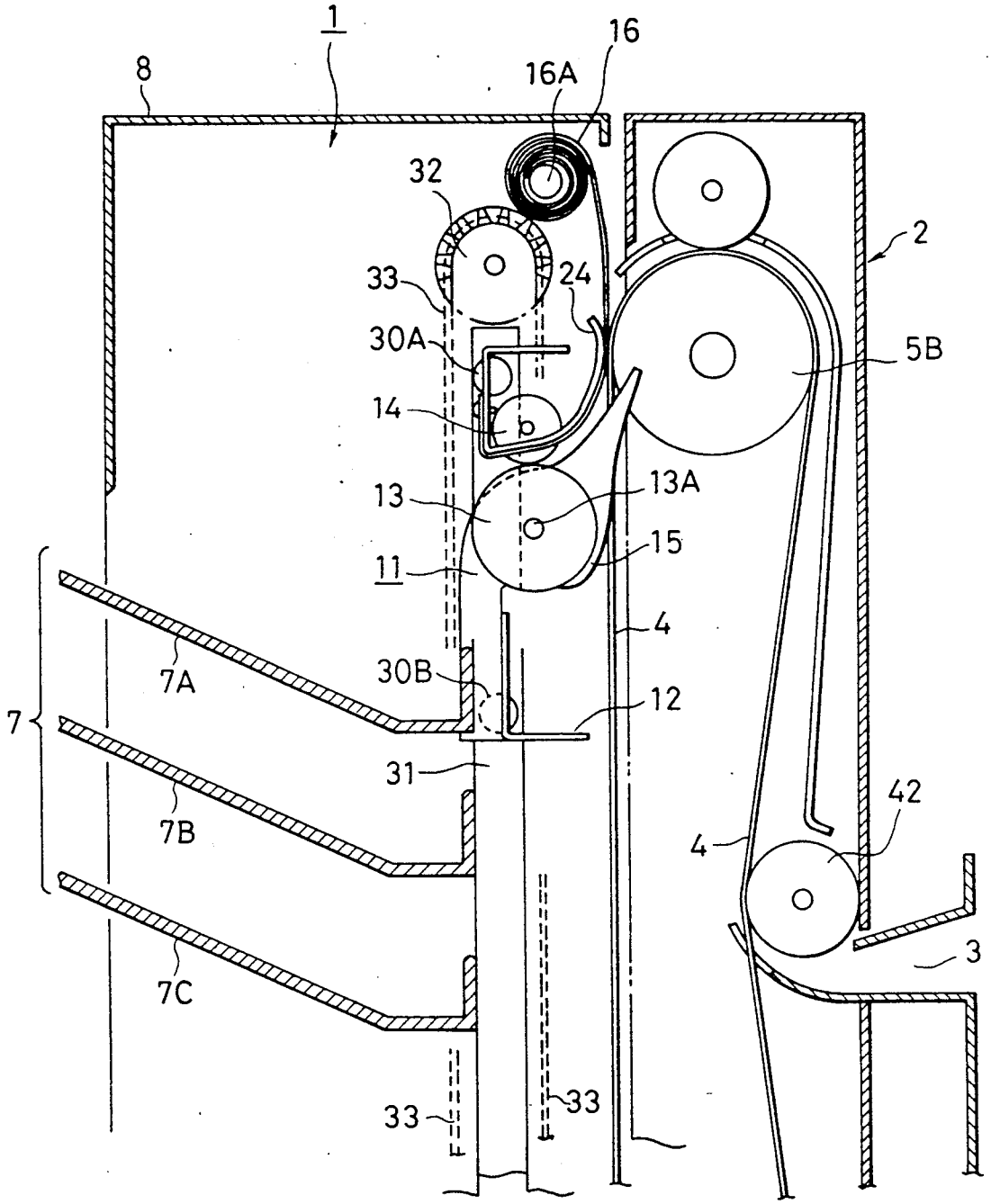
FIG. 4 is a sectional side elevational view showing the upper section of the sorting arrangement depicted in FIG. 2.
Figure 5:
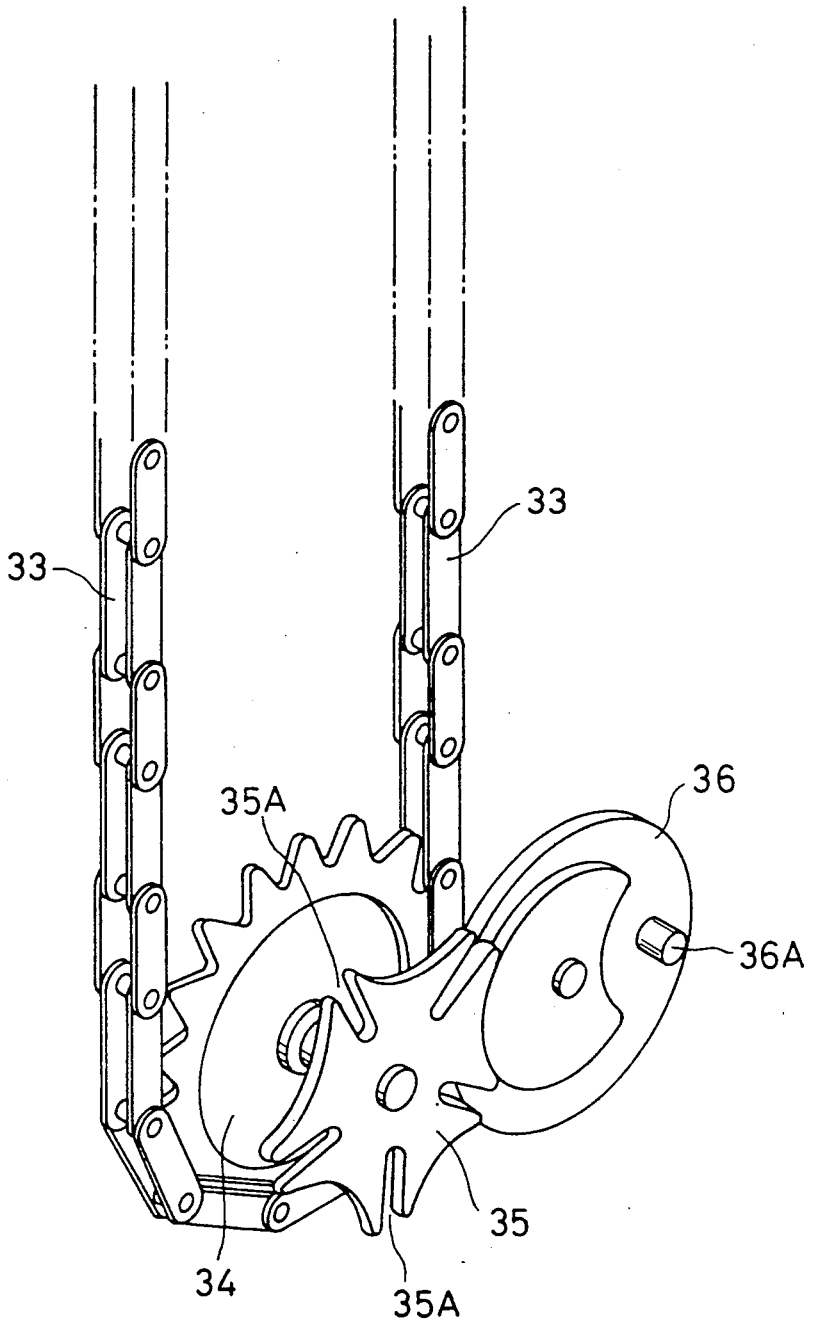
FIG. 5 is a perspective view showing a drive mechanism which is used in connection with the movement of the ejection unit.

FIG. 4 shows details of the mechanism via which the eject unit 11 is selectively raised and lowered within the sorting section 1, and selectively brought in the appropriate position with respect to a selected tray.

As shown in this figure, guide pins 30A and 30B which extend from either side of the eject unit 11 are slidably received in vertical guide slots 31 fixed to the side frame of the case 8.

The eject unit 11 is operatively connected to a sprocket 32 by a sprocket chain 33 (note the actual connection between the ejection unit 11 and the sprocket chain 33 is not shown). The ejection unit 11 is raised and lowered in accordance with the rotation of the sprocket 33. The lower end of the chain passes over a sprocket 34 (see FIG. 5).

A Geneva wheel 35 which is formed with five engagement slots 35A is mounted on the shaft of the sprocket 34 and arranged to cooperate with a Geneva cam 36 having a single drive pin 36A. The Geneva cam 36 is arranged to be driven by a reversible tray motor 37 by way of a non-illustrated drive connection.

With this arrangement, for each rotation of the Geneva cam 36 the Geneva wheel is induced to undergo 1/5 of a rotation. The sprocket cain 33 provides an operative connection between the sprocket 34 and the ejection unit 11 in a manner wherein the rotation of the sprocket 34 is translated in vertical linear movement of the ejection unit 11. It will be noted that the ratio of movement to non-movement with the Geneva cam/-wheel arrangement is 1:4.

The control of the tray motor 37 when the sorting device is switched to the non-sorting modes is such that it is induced to undergo two sequential rotations. This induces the situation wherein, such as shown in FIG. 4, the ejection unit 11 assumes a position wherein its outlet is located a position which is adjacent the very upper portion of the opening through which sheets are ejected into the tray (in this case tray 7A) and which is considerably higher with respect to the floor of the tray 7A as compared with the position which is assumed in the case of the sorting mode.

With this setting the number of sheets which can be ejected into the tray 7A is greatly increased as will be readily appreciated.

Referring back to FIG. 2, the feed opening 3 includes a guide plate 40 with which an incoming sheet detection sensor 41 is disposed. This sensor is arranged to detect a sheet being fed into the feed opening 3 and takes the form of a suitable light source, a photo diode and a suitable light path interrupting arrangement.

When a sheet is detected by the incoming sheet detection sensor 41 as being inserted into the feed opening 3, the feed motor 6 is energized. This induces the transfer belts 4 to be driven and brings about the situation wherein the sheet which has triggered the sensor, is drawn in between the belts 4 and an idler roller 42.

In the event that the sheet is not detected by a sheet detection sensor arrangement 43 within a predetermined period, a control unit 50 (shown in FIG. 6) is arranged to indicate that jamming of the sheet has occurred and to issue a command which stops the operation of the feed motor 6.

As best seen in FIG. 2 the sheet detection sensor arrangement 43 comprises a light source 43A and a light responsive element 43B such as a photo diode. A light beam 43C is produced by the light source 43A and aimed at the light responsive element 43B. As shown in FIG. 2, this light beam 43C is produced in a manner so that it extends between two adjacent guide fingers 15. When a sheet is being deflected by these fingers 15 and is sliding toward the eject rollers 13, 14, the beam 43C is interrupted.

It will be noted at this point that the present invention is not limited to this particular sensor location and a similar arrangement an alternatively be disposed on the tray side of the ejection unit 11 if so desired.

An ejection unit position sensor 44 is arranged above the ejection unit 11 and arranged to produce a signal indicative of the ejection unit 11 having assumed a predetermined position. In the instant embodiment this predetermined position is one in which the ejection unit 11 has assumed a position suited for ejecting into the upper tray 7A.

When the ejection unit position sensor 44 detects the eject unit 11 having assumed the above mentioned position suited for ejecting sheets into the upper tray 7A, a signal is issued which stops the upward movement of the unit 11 and initiates the running of a control routine.

A cam rotation sensor 45 is disposed in the lower portion of the sorting section 1 proximate the Geneva cam 36 and arranged to sense the completion of each rotation of the same. As the rotation of the Geneva cam has a predetermined relationship with the position of the ejection unit 11, this sensor serves in effect to monitor the position of the ejection unit with respect to the trays 7.

In this instance it is possible to arrange the cam rotation sensor 45 to comprise a source of light, a shutter plate which is mounted on the Geneva cam 36 and a light sensitive photo diode. By arranging the light source and the photo diode in a suitable manner with respect to the Geneva cam 36 to which the shutter plate is mounted, each time the plate reaches a predetermined position the light from the light source is interrupted toward the photo diode.

With this arrangement, each issuance of a signal from the cam rotation sensor 45, the ejection unit 11 can be taken to mean that the ejection unit 11 has been moved into position with respect to the next tray and that the next sheet can be ejected.

Figure 6:
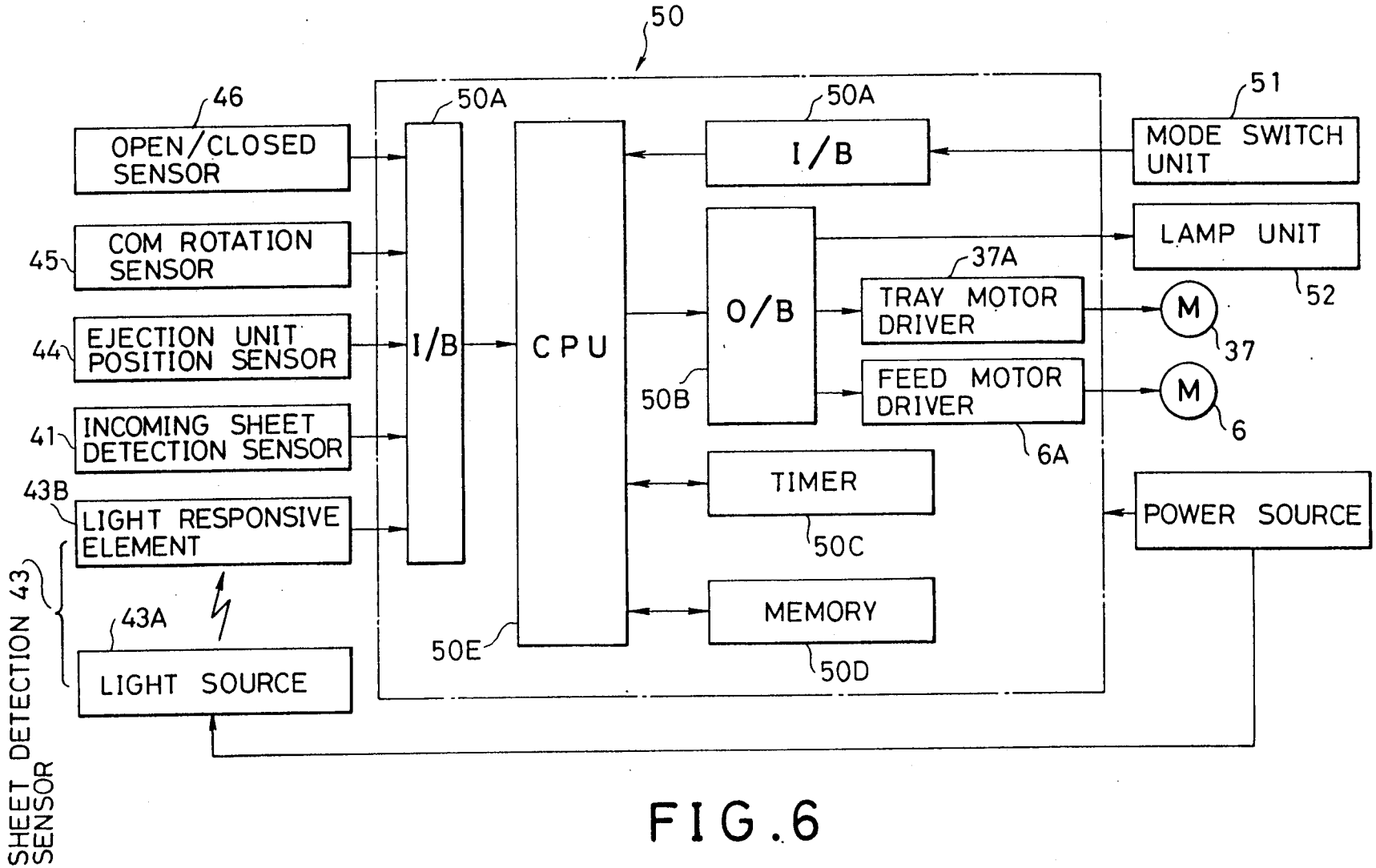
FIG. 6 is a block diagram showing details of the control circuitry which is used in connection with the present invention.

FIG. 6 shows the arrangement of the control unit 50 in block diagram form. As will be appreciated from this figure, the control unit 50 includes a microprocessor which includes input boards 50A which are arranged to receive input signals from a mode switch unit 51 along with signals from the above mentioned sensor 41 and 43 to 46.

The mode switch unit 51 is arranged to enable manual switching between a sorting mode, a non-sorting mode and a group ode, and to generate signals indicative of the selected setting. Alternatively, these signals can be derived from the host machine to which the sorting machine is connected.

The output board 50B of the microcomputer is operatively connected with the above mentioned feed and tray motors 6, 37 via a feed motor driver circuit 6A and a tray motor driver circuit 37A, respectively.

An LED type sorting device status indicating lamp unit 52 is also connected to the output board 50B.

A timer 50C and ROM 50D are operatively connected with a CPU 50E via suitable bus arrangements.

NON-SORTING MODE

The operation of the above described arrangement is such that when the device is switched on, the CPU 50E is subject to an initialization which results in the tray motor 37 being energized in a manner which moves the ejection unit 11 up toward the predetermined position wherein it is situated to eject sheets into the upper tray 7A of the tray array. Upon reaching the upper tray position, the ejection unit position sensor 44 issues a signal indicative of the same and the movement of the unit 11 is halted. Under these conditions the sorting device is conditioned for non-sorting operation.

It should be noted that when the sorting device is set to produce the non-sorting mode of operation, the status indicating lamp unit 52 is energized to suitably indicate that all of the ejected sheets will be ejected and collected on the same tray (in this case the upper tray 7A).

During this mode of operation, when the incoming sheet detection sensor 41 assumes a high level (ON) indicating that a sheet has been fed into the feed opening 3, the signal which is produced by this sensor is fed to the CPU 50E via the input board 50A. In response to this calculations are performed in the CPU and result in the output of signals to the feed motor driver 6A via the output board 50B. The feed motor 6 is energized and the sheet is transferred to the ejection unit 11 and then ejected into the upper tray 7A.

In the event that incoming sheet detection sensor 41 does not output a high level signal for a predetermined period (e.g. 3 seconds) following the detection of the sheet by the sheet detection sensor arrangement 43, the control program which is being run in the CPU is designed to determine that the supply of sheets has been finished and the feed motor 6 is de-energized.

However, in the case that either sensors 41 or 43 output high level signals for more than 2 seconds, or if the incoming sheet detection sensor 41 continues to produce a high level signal for a given period (e.g. 3 seconds), and the sheet detection sensor arrangement 43 fails to indicate the presence of a sheet (i.e. continues to output a low level signal) it is deemed that a "jam" has occurred. In response to this, the feed motor 6 is de-energized to stop the operation of the same and the status indicating lamp unit 52 is suitably energized to indicate the instant undesirable situation. In addition, the tray motor 37 control signal is set to a low level (non-energizing) and is locked.

Under these conditions, in order to release the locking following suitable correction of the situation which has brought about the jam, all that is necessary is to press the non-sorting mode switch on the switch unit 51. This resets the sorting device to assume the state prior the jamming.

It should be noted that the displacement of the ejection unit 11 with respect to the upper tray 7A into which the sheets are to be ejected during the non-sorting mode is twice that which occurs during sorting and group modes (which will be discussed later) in this embodiment. It is also possible that the displacement of the ejection unit 11 with respect to the upper tray 7A during non-sorting mode is an integer multiple such as 3 or 4 times that possible during the sorting and group modes.

SORTING MODE

During the sorting mode, in response to the sort mode switch being set to a position wherein a high level (ON) signal is produced, the ejection unit 11 is moved toward the appropriate ejection position with respect to tray 7B (Viz., the second tray from the top) which is designated to be the top or first tray during the sorting mode. When the movement of the ejection unit 11 is completed, the status indicating lamp unit 52 is energized to indicate that the sorting device has been conditioned to produce the sorting mode. In this case the movement of the ejection unit 11 is such that, following the signal from ejection unit position sensor 44 assuming a high level (ON) the system awaits the cam rotation sensor 45 to indicate that the Geneva cam 36 has completed two rotations. It should be noted that the two rotations are necessary to lower the ejection unit 11 from the high non-sorting position to that suited for ejection into tray 7B.

When the first sheet is detected by sensor 41 as having been received in the feed opening 3, the feed motor 6 is energized and the transfer belts 4 are induced to move. Under these conditions, the sheet is carried between the belt and the roller 42, and transferred up the upper idler pulley 5B. From this position the direction of travel is reversed and the sheet is induced to descent while being held against the faces of the transfer belts by the spring strips 16. Upon reaching the guide fingers 15 of the ejection unit 11 the sheet is guided away from the transfer belts and caused to pass between the ejection and idler rollers 13, 14. Under the influence of the rotating rollers 13, 14 the sheet is ejected into tray 7B.

0.25 seconds after the first sheet is detected as having been ejected into tray 7B the ejection unit 11 is moved via a single rotation of the Geneva cam 36, toward the position required for ejecting the second sheet. During this mode the second sheet is ejected into tray 7C.

In accordance with sequential repetition of the above type of operation it is possible to sort a maximum of 20 sheets into corresponding trays.

During this mode of operation, even though sheets are being continuously supplied into the sorting device, in the event that incoming sheet detection sensor 41 fails to produce a high level signal for more than 3 seconds following an interruption of the light beam 43C produced by the sheet detection sensor arrangement 43, it is assumed that the supply of the first set of sheets has finished. The feed motor 6 is stopped and preparations made to receive the next round.

At this point in time, the number of sheets which have been continuously supplied is ascertained and the number set in the memory 50D in the microcomputer. Following this recording, the tray motor 6 is energized to rotate in direction which is the reverse of that induced during the sorting of the first round of sheets. This brings about the situation wherein the ejection unit 11 is moved stagewisely back from the last ejection position back towards tray 7B.

During the sorting mode the jam detecting process is basically similar to that employed during the non-sorting mode. However, in this instance the time from which the incoming sheet detection sensor 41 detects a sheet in the feed opening 3, to the time the sheet detection sensor arrangement 43 produces a high level signal, is varied from 3.2–4.8 seconds depending on the position of the ejection unit 11 and the distance through which a sheet must be moved before reaching the ejection unit 11.

GROUP MODE

During the group mode, in response to the group mode switch being set to an ON position, the ejection unit 11 is moved to tray 7B and at the same time the status indicating lamp unit 52 is energized in a manner to indicate the instant selection.

The movement of the ejection unit 11 during this mode is the same as that of the sorting mode. When the first sheet is detected by incoming sheet detection sensor 41 as having entered the feed opening 3, the feed motor 6 is energized and the sheet is transferred to tray 7B which is also used as the top tray in this mode.

As sheets are continuously being supplied, in the event that the incoming sheet detection sensor 41 does not produce a high level signal for three seconds following a positive detection of a sheet by the sensor arrangement 43, it is assumed that the last sheet of the first round has been ejected into a tray, and the feed motor 6 is stopped.

At this time, the ejection unit 11 is moved one step down via a single rotation of the Geneva cam 36, into a position ready ejecting the next round of sheets into tray 7C.

However, as there are only 20 trays available in the instant mode, the number of groups which can be collated is accordingly limited to 20.

It should be noted that while each of the operations have been disclosed in a "stand alone" context, it will be understood that it is within the scope of the present invention t interface the sorting device with a host machine and remotely control the operation of the sorting device in response to commands from the host.

It should be further noted that while given time values such as 3 seconds, 3.2–4.8 seconds have been quoted, the present invention is not limited to these particular values and can be suitably set as the conditions demand.

The invention has been described in detail with respect to preferred embodiments, and it will now be apparent from the foregoing to those skilled in the art that changes and modifications may be made without departing from the invention in its broader aspects, and it is the invention, therefore, in the appended claims to cover all such changes and modifications as fall within the true spirit of the invention.

What is claimed is:

1. A sorting machine comprising:

a sorting portion;

a feed portion which is openable with respect to said sorting portion;

a plurality of tray bins which are arranged on a frame in said sorting portion in a fixed vertical array with a predetermined space therebetween, each of said tray bins having an entrance through which sheets can be ejected thereonto;

transport means, having an endless transport belt which is disposed in said feed portion, for vertically transporting a recorded sheet introduced through a feed opening;

discharge means, disposed in said sorting portion and moveable along said entrances of said tray bins for ejecting a sheet onto said tray bins, said discharge means comprising a discharge roller mounted on a discharge roller shaft, a pulley mounted on a drive shaft and driven by said transport belt, said pulley being in contact with the exterior surface of said transport belt, and gears engaged with each other and mounted on said discharge roller shaft and said drive shaft respectively, so that said discharge roller is driven by said transport belt;

guide means for transferring the recorded sheet to said discharge means after transporting by said transport means;

shifting means, disposed in said sorting portion, for intermittently shifting said discharge means and said guide means upwardly and downwardly to a tray into which the recorded sheet is to be discharged;

hold means, being retractable in opposite directions along a transport direction of said recorded sheet in response to a shifting of said discharge means, for holding said recorded sheet between said transport means and said hold means;

means for detecting a predetermined mode of operation including a non-sorting mode;

means responsive to the detection of a non-sorting mode by said detecting means for moving said discharge means to an uppermost tray of said tray bins and locating said discharge means at a distance above said uppermost tray which is greater than said predetermined space, wherein said hold means comprises a spiral spring of elastic strip metal material which has one end wound around a rotatable member rotatably mounted on a shaft disposed in said sorting portion and the other end fastened to said discharge means, said spiral spring functioning so as to rewind with constant force around said rotatable member under its own spring force upon shifting of said discharge means upwardly; and means responsive to the detection of a sorting mode by said detecting means for moving said discharge means to a second uppermost tray of said tray bins and, wherein said uppermost tray is not used in said sorting mode.

2. A sorting machine as claimed in claim 1 wherein said shifting means comprises:

a motor;

a Geneva cam in drive connection with said motor;

a Geneva wheel having slots arranged at equally angularly spaced in operative connection with said Geneva cam;

a sprocket, said sprocket being connected with said Geneva wheel to be driven thereby;

a chain, said chain being operatively arranged with said sprocket and connected to said ejecting means.

3. A sorting machine as claimed in claim 2 wherein said Geneva cam and said Geneva wheel are arranged so that one rotation of said Geneva cam moves said ejecting means through a distance by which each of the entrances of the trays are spaced.

4. A sorting machine as claimed in claim 3 wherein said distance above said uppermost tray is equal to integer multiples of said predetermined space.

5. A sorting machine as claimed in claim 1, wherein said elastic strip engages a surface of the recorded sheet against said transport belt, said elastic strip having a smooth surface adjacent the recorded sheet, said elastic strip having its lower end connected with said discharge means and its upper end connected to said rotatable member for resiliently retracting the elastic strip.

6. A sorting device as claimed in claim 5, wherein said discharge means further comprises:

a support member;

an idler roller which is mounted on said support member in contact with said discharge roller and which is driven to rotate by the rotation of said discharge roller, wherein said guide means guides the recorded sheet between said discharge roller and said idler roller toward said tray entrance.

7. A sorting device as claimed in claim 1, wherein said discharge means further comprises:

a support member;

an idler roller which is mounted on said support member in contact with said discharge roller and which is driven to rotate by the rotation of said discharge roller, wherein said guide means guides the recorded sheet which passes between said discharge roller and said idler roller toward a tray entrance.

8. A sorting machine as claimed in claim 1 wherein said pulley is connected with said discharge roller through said gears so that said discharge roller has a surface speed which is greater than the surface speed of said transport belt.

* * * * *